US006951243B2

(12) United States Patent
Nilson et al.

(10) Patent No.: US 6,951,243 B2
(45) Date of Patent: Oct. 4, 2005

(54) AXIALLY TAPERED AND BILAYER MICROCHANNELS FOR EVAPORATIVE COOLLING DEVICES

(75) Inventors: Robert Nilson, Cardiff, CA (US); Stewart Griffiths, Livermore, CA (US)

(73) Assignee: Sandia National Laboratories, Livermore, CA (US)

( * ) Notice: Subject to any disclaimer, the term of this patent is extended or adjusted under 35 U.S.C. 154(b) by 71 days.

(21) Appl. No.: 10/683,938

(22) Filed: Oct. 9, 2003

(65) Prior Publication Data

US 2005/0081552 A1 Apr. 21, 2005

(51) Int. Cl.[7] ..... F28D 15/00

(52) U.S. Cl. ..... 165/104.21; 165/185; 165/80.4; 361/700; 174/15.1

(58) Field of Search ..... 165/80.4, 185, 165/104.33, 104.21; 361/699, 700; 257/714–716; 174/15.1

(56) References Cited

U.S. PATENT DOCUMENTS

| | | | | | |
|---|---|---|---|---|---|
| 4,567,505 | A | * | 1/1986 | Pease et al. | 257/713 |
| 4,953,634 | A | * | 9/1990 | Nelson et al. | 165/147 |
| 5,453,641 | A | * | 9/1995 | Mundinger et al. | 257/714 |
| 5,978,220 | A | * | 11/1999 | Frey et al. | 361/699 |
| 6,039,114 | A | * | 3/2000 | Becker et al. | 165/170 |
| 6,101,715 | A | * | 8/2000 | Fuesser et al. | 29/890.03 |
| 6,253,835 | B1 | * | 7/2001 | Chu et al. | 165/80.4 |
| 6,457,515 | B1 | * | 10/2002 | Vafai et al. | 165/80.4 |
| 2003/0062149 | A1 | * | 4/2003 | Goodson et al. | 165/104.11 |

OTHER PUBLICATIONS

Catton, I. and Stroes, G. R., 2002, "A Semi–Analytical Model to Predict the Capillary Limit of Heated Inclined Triangular Capillary Grooves," ASME Journal of Heat Transfer, 124, pp. 162–168.

Sivaraman, A., De, S. and Dasgupta, S., 2002, "Experimental and Theoretical Study of Axial Dryout Point for Evaporation from V–Shaped Microgrooves," Intl. J. Heat Mass Transf., 45, pp. 1535–1543.

Peles, Y. P. and Haber, S., 2000, "A Steady One Dimensional Model for Boiling Two Phase Flow in a Triangular Microchannel," Intl. J. Multiphase Flow, 26, pp. 1095–1115.

Wayner, P. C., 1999, "Intermolecular Forces in Phase–Change Heat Transfer: 1998 Kern Award Review," AIChE Journal, 45(10), pp. 2055–2068.

Ehrfeld, W. and Schmidt, A., 1998, "Recent Developments in Deep X–Ray Lithography," J. Vac. Sci. Technol. B 16(6), pp. 3526–3534.

Stroes, G. R. and Catton, I., 1997, "An Experimental Study of the Capillary Performance of Triangular Versus Sinusoidal Channels," ASME Journal of Heat Transfer, 119, pp. 851–853.

(Continued)

*Primary Examiner*—Terrell Mckinnon
(74) *Attorney, Agent, or Firm*—Timothy P. Evans

(57) ABSTRACT

The invention consists of an evaporative cooling device comprising one or more microchannels whose cross section is axially reduced to control the maximum capillary pressure differential between liquid and vapor phases. In one embodiment, the evaporation channels have a rectangular cross section that is reduced in width along a flow path. In another embodiment, channels of fixed width are patterned with an array of microfabricated post-like features such that the feature size and spacing are gradually reduced along the flow path. Other embodiments incorporate bilayer channels consisting of an upper cover plate having a pattern of slots or holes of axially decreasing size and a lower fluid flow layer having channel widths substantially greater than the characteristic microscale dimensions of the patterned cover plate. The small dimensions of the cover plate holes afford large capillary pressure differentials while the larger dimensions of the lower region reduce viscous flow resistance.

40 Claims, 15 Drawing Sheets

OTHER PUBLICATIONS

Ha. J. M. and Peterson, G. P., 1996, "The Interline Heat Transfer of Evaporating Thin Films Along a Micro Grooved Surface," ASME Journal of Heat Transfer, 118, pp. 747–755.

Faghri, A, 1995, Heat Pipe Science and Technology, Taylor and Francis Publishers, New York, NY.

Stroes, G. R., Rohloff, T. J. and Catton, I., 1992, "An Experimental Study of the Capillary Forces in Rectangular vs. Triangular Channels," Proceedings of the 28$^{th}$ National Heat Transfer Conference, Aug. 9–12, Dan Diego, HTD–vol. 200, pp. 1–7.

Stephan, P. C. and Busse, C. A., 1992, "Analysis of Heat Transfer Coefficient of Grooved Heat Pipe Evaporator Walls," Int. J. Heat Mass Transf., 35(2), pp. 383–391.

Xu, X. and Carey, V. P., 1990, "Film Evaporation from a Micro–Grooved Surface—An Approximate Heat Transfer Model and Its Comparison with Experimental Data," J. Thermophysics, 4(4), pp. 512–520.

Becker, E. W., Ehrfeld, W., Hagmann, P., Maner, A. and Munchmeyer, D., 1986, "Fabricaton of Microstructures with High Aspect Ratios and Great Structural Heights by Synchrotron Radiation Lithography, Galvanoforming and Plastic Moulding (LIGA Process)," Microelectronic Eng., 4, pp. 35–56.

Schneider, G. E. and DeVos, R., 1980, "Nondimensional Analysis for the Heat Transport Capability of Axially Grooved Heat Pipes Including Liquid/Vapor Interaction," AIAA Paper No. 80–0214.

Haskell, K. H., Vandevender, W. H. and Walton, E. L., 1980, "The SLATEC Mathematical Subroutine Library: SNL Implementation," SAND80–2992, Sandia National Laboratories, Albuquerque, NM.

Ayyaswamy, P. S., Catton, I., and Edwards, D.K., 1974, "Capillary Flow in Triangular Grooves," ASME J. Appl. Mech., pp. 332–336.

* cited by examiner

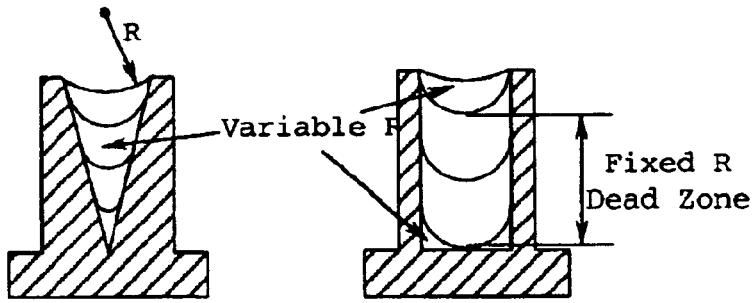
FIG. 3A FIG. 3B
Prior Art
FIG. 4C
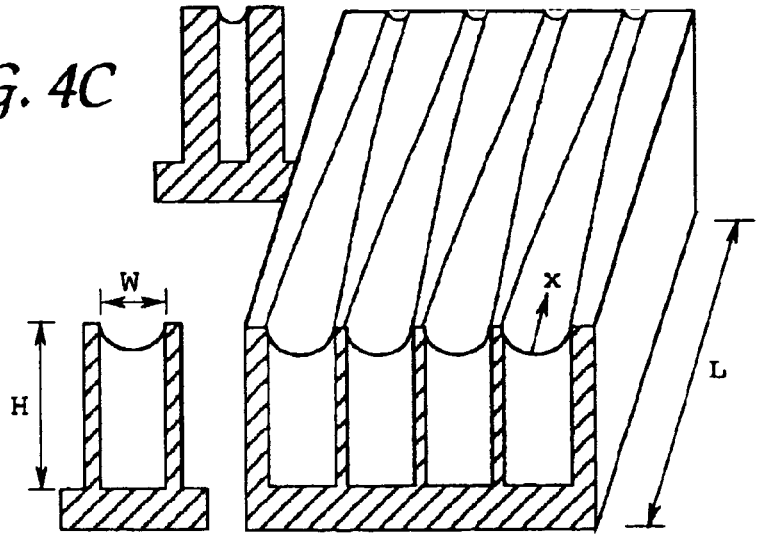
FIG. 4B
FIG. 4A

AXIALLY TAPERED AND BILAYER MICROCHANNELS FOR EVAPORATIVE COOLLING DEVICES

STATEMENT OF GOVERNMENT INTEREST

This invention was made with Government support under government contract no. DE-AC04-94AL85000 awarded by the U.S. Department of Energy to Sandia Corporation. The Government has certain rights in the invention, including a paid-up license and the right, in limited circumstances, to require the owner of any patent issuing in this invention to license others on reasonable terms.

BACKGROUND OF THE INVENTION

Evaporative cooling devices such as heat pipes and capillary pumped loops utilize capillary suction to draw liquid into the evaporation region. This capillary suction results from the pressure differential across the phase interface between a liquid and vapor. According to the Laplace-Young relation, the interfacial pressure difference is proportional to the surface tension and is inversely proportional to the radius of curvature of the interface. Further, since the pressure within the liquid is generally less than that in the adjacent gas, the liquid pressure decreases as the radius of curvature becomes smaller. Thus, liquid is drawn toward regions where the radius of curvature is small and the liquid pressure is low.

In the typical heat pipe configuration of FIG. 1 heat is applied at one end causing evaporation of liquid from the wick. The vapor generated raises the gas phase pressure at the hot end causing transport of vapor along the open center toward the cold end. Heat extraction at the cold end condenses the vapor. The condensate is absorbed by the wick and then transported through the wick by capillary suction back to the hot region where the liquid pressure is lower.

The capillary pumped loop of FIG. 2 is similar in concept except that the evaporator and the condenser units are connected by a pair of tubes or channels that facilitate greater separation between the heat source and sink, particularly in cases where space is limited. In this device the capillary suction of the wick must overcome the viscous friction in the connector tubes as well as the friction within the wick itself. However, it is also true that the capillary suction of a heat pipe must overcome the frictional pressure drops in both phases, and in that configuration the counterflow of the vapor and liquid adds to the overall flow resistance.

In traditional evaporative cooling devices the wick is constructed of a porous material such as a sintered metal, a felt metal, or a layered screen (see A. Faghri "*Heat Pipe Science and Technology*" Taylor and Francis Publishers, 1995). Metals are used because high thermal conductivity is needed to transfer heat through the wick to the liquid/vapor interface where evaporation is intended to occur, thus avoiding bubble formation within the wick. The performance of a wick material is strongly dependent upon its microstructure. It is generally beneficial to have relatively small pores or interstices within the material since this reduces the minimum radius of curvature of the phase interface, increasing the capillary pressure difference available to draw liquid into the wick. However, smaller pores result in greater frictional resistance and, hence, slower rates of liquid transport through the wick. Thus, the optimum pore size must strike a balance between these opposing requirements.

Engineered wick structures are now being produced by modem microfabrication techniques. Electrical discharge machining (EDM) of metals and chemical etching of silicon have been used to create microgrooves having triangular, trapezoidal, sinusoidal, and nearly rectangular cross sections (Stores, et al., *Proceedings of the 28th National Heat Transfer*, Aug. 9–12, San Diego, v. 200, 1992, pp. 1–7; and *Journal of Heat Transfer*, v. 119, 1997, pp. 851–853 and Sivaraman, et al., *International. Journal of Heat and Mass Transfer*, v.45,2002, pp.1535–1543). Of these alternative shapes, triangular grooves have received by far the most attention (Xu, et al., *Journal of Thermophysics*, v. 4, no.4, 1990, pp. 512–520; Ha, et al., *Journal of Heat Transfer*, v. 118, 1996, pp. 747–755; Peles, et al., *International Journal of Multiphase Flow*, v. 26, 2000, pp. 1095–1115; and Catton, et al., *Journal of Heat Transfer*, v. 124, 2002, pp. 162–168). The focus on this geometry may be largely because it provides a monotonic decrease in meniscus radius and capillary pressure as the depth of the fluid decreases and the meniscus recedes into the wedge-shaped channel, as illustrated in FIG. 3A. However, the triangular shape provides only half the cross-sectional area of a rectangular channel, the viscous friction is greater and, in addition, deep triangular cross sections cannot be readily produced using lithographic processes that have been so successful in mass production of semiconductor devices.

Lithographic processes are well suited to the fabrication of devices having a great multiplicity of highly detailed microscale features. In particular, the LIGA process can be used to produce a multiplicity of metal channels having widths down to a few microns and depths as large as a millimeter or more (see Becker, et al., *Microelectronic Engineering*, v. 4, 1986, pp. 35–56; and Ehrfeld, et al., *Journal of Vacuum Science and Technology* (*B*), v. 16, no.6, 1998, pp. 3526–3534). In LIGA, a high-energy x-ray source is used to expose a thick photoresist, typically PMMA, through a patterned absorber mask. The exposed material is then removed by chemical dissolution in a development bath. This development process yields a nonconducting mold having a conducting substrate beneath deep cavities that are subsequently filled by electrodeposition. The resulting metal parts may be the final product or may be used as injection or embossing molds for mass production. However, since the exposure beam is generally aligned perpendicular to the patterned mask, LIGA and other lithographic processes are best suited for fabrication of channels having parallel sidewalls and hence a rectangular cross section. Multiple x-ray exposures at different angles to the mask could be used to produce triangular channels, but not without added complexity and loss of precision.

Although amenable to LIGA fabrication, straight rectangular microchannels have one notable disadvantage. As illustrated in FIG. 3B, the capillary pressure varies with the liquid height (depth) in the channel only so long as the meniscus remains attached to the top comers of the channel. The radius of curvature of the interface may then range anywhere between infinity for a flat meniscus to a minimum radius that corresponds to the minimum wetting angle. However, once the meniscus recedes into the channel and leaves the singular corner point, the wetting angle is fixed at a particular minimum value determined by liquid and solid interaction energies. Thus there is a large range of liquid heights (depths) in the channel for which the radius of curvature and the corresponding capillary pressure are invariant. Within this "dead zone" (see Stores, et al.; *Journal of Heat Transfer*, v. 119, 1997, pp. 851–853) there will be no capillary pressure variation to draw fluid toward the drier end of the channel. It is only when the meniscus reaches the channel bottom and begins to recede into the corners that a capillary pressure gradient can again be established. But in this regime the fluid depth can be no greater than half the channel width.

SUMMARY OF THE INVENTION

The present invention describes microscale channels that are engineered to have an axial variation in the minimum radius of meniscus curvature along the primary flow direction substantially independent of the depth of the working fluid in the channel.

It is an object of the invention to provide an evaporative cooling device comprising one or more channels whose cross section is axially reduced to control the maximum capillary pressure differential between liquid and vapor phases of a liquid contained within the channel.

It is also an object of the invention to provide an evaporative cooling device comprising one or more channels whose cross section is tapered from wide to narrow in the direction of flow.

It is yet another object of the invention to provide channels of fixed width that are patterned with an array of microfabricated post-like features such that the spacing between these features gradually decreases in the direction of the flow path.

It is again another object of the invention to provide bilayer channels comprising an upper cover plate having a pattern of slots or holes of axially decreasing size and a lower fluid flow layer having channel widths substantially greater than the characteristic microscale dimensions of the patterned cover plate.

Still other objects and advantages of the present invention will be ascertained from a reading of the following detailed description and the appended claims.

BRIEF DESCRIPTION OF THE DRAWINGS

FIG. 3A shows a set of conventional microchannels having triangular cross sections.

FIG. 3B shows a set of conventional microchannels having rectangular cross sections.

FIGS. 4A–4C show aspects of an axially tapered channel; the simplest embodiment of the present invention; FIG. 4A is an isometric view of the embodiment while FIG. 4B and FIG. 4C are side views of the respective forward and rearward ends of a typical channel.

FIGS. 5A and 5B respectively show a top view and side view of a single channel wherein three partitions divide the channel into four narrower channels.

FIG. 6A is a top view of the channel wherein several rows of cylindrical posts occupying most of the cross section of the channel; FIG. 6B is a side view of one row of the cylindrical posts showing the meniscus formed between adjacent posts.

FIG. 7A is a top view of the channel wherein several rows of cylindrical posts occupying most of the cross section of the channel and wherein the density of post increases, thereby decreasing the width of the meniscus between posts; FIG. 7B is a side view of one row of the cylindrical posts showing the meniscus formed between adjacent posts.

FIG. 8A is a top view of the channel wherein one slot is present; FIG. 8B is a side view showing the slotted cover plate and the effect on the meniscus at the slot.

FIG. 9A is a top view of the channel wherein a single discontinuous slot is shown formed into the cover plate; FIG. 9B is a side view showing the slotted cover plate and the effect on the meniscus at the slot FIG. 10A is a top view showing a cover plate punctuated by an array of rows of circular holes having decreasing diameters but increasing density in the direction of flow; and FIG. 10B is a side view showing the punctuated cover plate and the effect on the meniscus at each hole.

FIG. 12A shows a top view of the unit looking down onto a microchannel array; FIG. 12B shows a side lateral cross-sectional view of the evaporator and condenser unit showing the disposition of the microchannel evaporator array and the condenser array above; and FIG. 12C shows a longitudinal cross-sectional view of the same evaporator and condenser cooling device viewed through one micro-channel illustrating the operation of the device.

DETAILED DESCRIPTION OF THE INVENTION

The simplest embodiment of this invention is an axially tapered microchannel formed into the body of a thermally conductive substrate member and having a flow cross-section that narrows in width along the intended flow path, as illustrated in FIGS. 4A through 4C. Such channels have no dead zone; they can be fabricated by lithographic processes such as LIGA, and they generally perform much better than prior art triangular grooves or straight rectangular channels. Through mathematical modeling it is shown here that the maximum sustainable heat flux for a tapered channel may exceed that of a comparable triangular groove by a factor of three to six. Tapered channels, such as those shown in FIG. 4A, also provide much more robust performance than straight rectangular channels by a three to four fold increase in their ability to overcome opposing gravitational forces. FIGS. 4B and 4C illustrate cross-sectional views of a representative channel at opposite ends of its length. When applied to capillary pumped loops, tapered channels provide a desirable insensitivity to the magnitude of external pressure drops within auxiliary connector tubes. In particular, all prior art methods disclose structures having a constant cross-sectional width. In these cases the driving potential for liquid flow relies upon changes in depth along the length of the channel. The present methods, however, establish the potential gradient for liquid flow by providing channels whose cross-sectional width changes (either continuously or in a step-wise manner) along the length of the channel. This simple feature, therefore, avoids difficulties with flow stagnation due to liquid evaporation and channel "dry-out" at the "hot end" of the channel.

Figure 1:
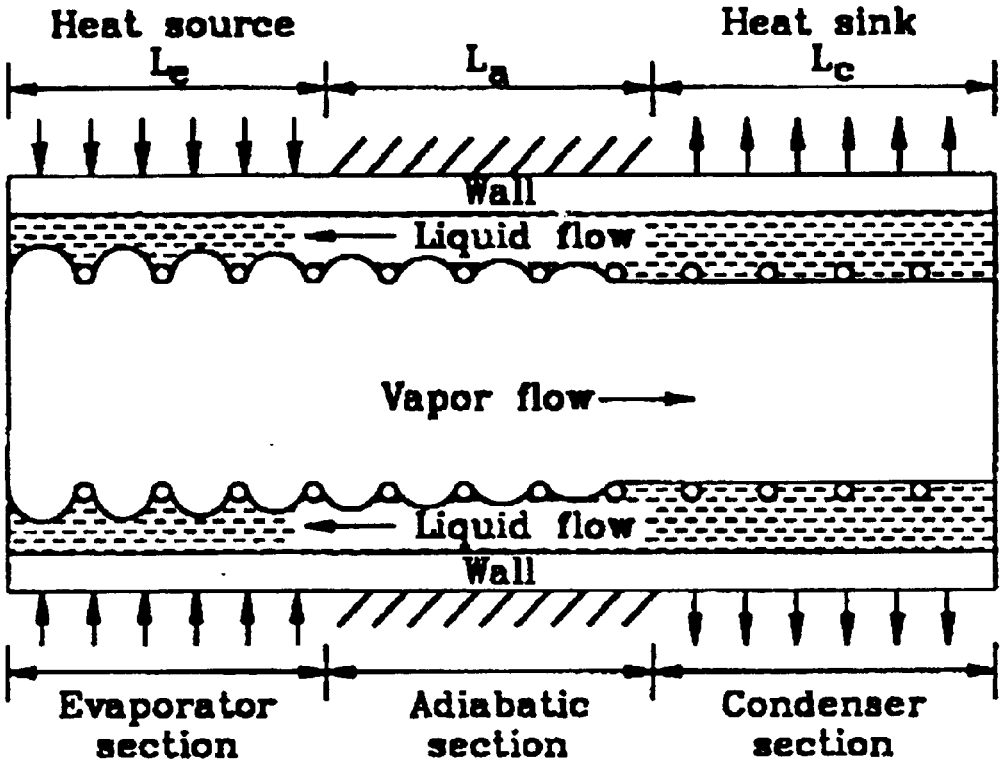
FIG. 1 Prior Art
FIG. 1 illustrates a conventional prior art heat pipe.
Figure 2:
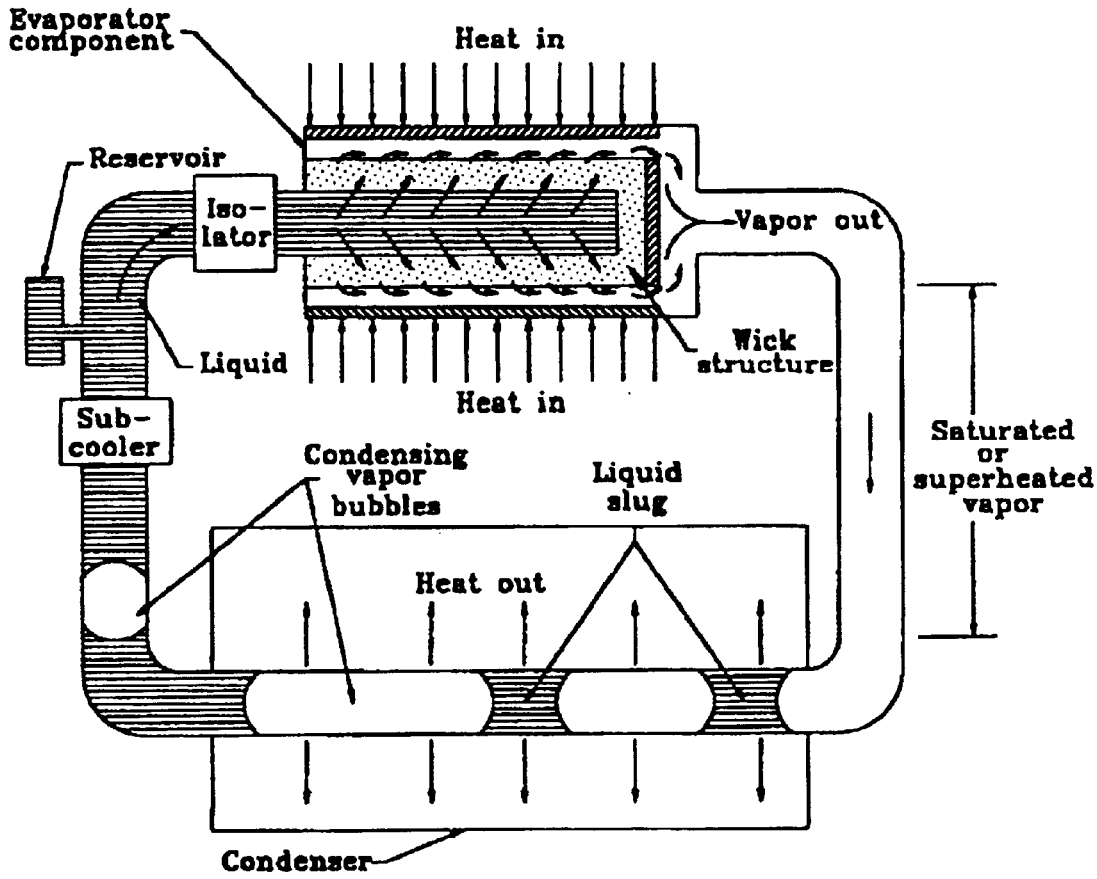
FIG. 2 Prior Art
FIG. 2 illustrates a conventional prior art capillary pumped loop.
Figure 5A:
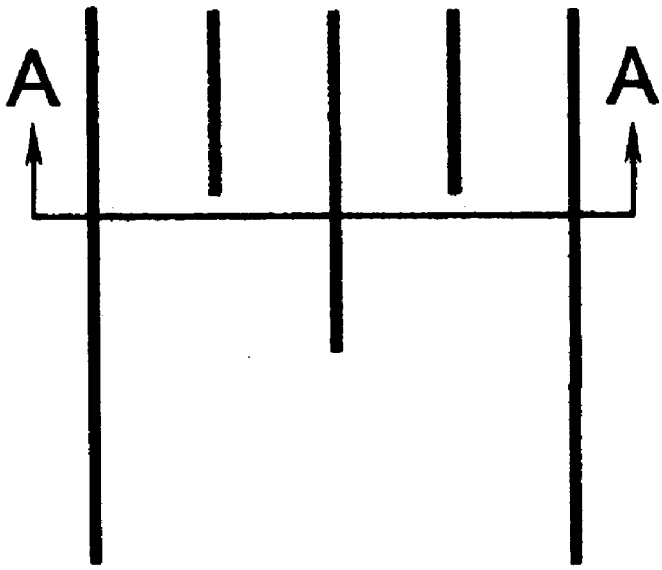
FIGS. 5A and 5B show a tapered channel system having a stepwise reduction in channel width.
Figure 5B:
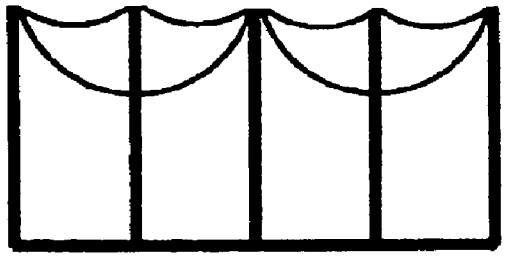

A second embodiment of the present invention is illustrated schematically in FIGS. 5A and 5B which show the top and side views of a channel divided by dividing walls. Here the reduction in channel width is implemented in a step-wise fashion through repetitively dividing the channels with axial partitions that divide the channels along a portion of their length. Two or three dividers provide substantial benefits particularly when the fabrication technology permits fabrication of narrow dividing partitions. Calculations reported here describe optimal partition lengths and expected device performance.

Figure 6A:
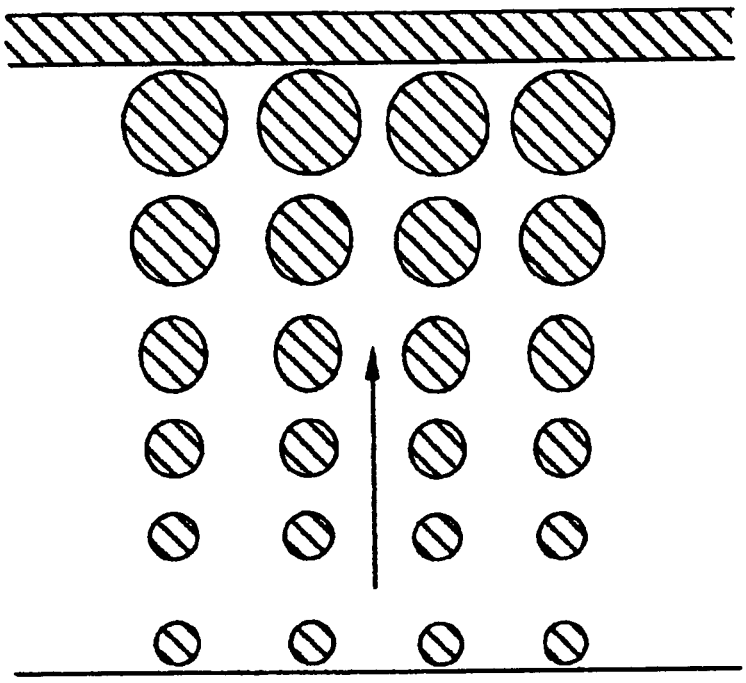
FIGS. 6A and 6B show a flow passage bounded by an array of rows of cylindrical posts of increasing size.
Figure 6B:
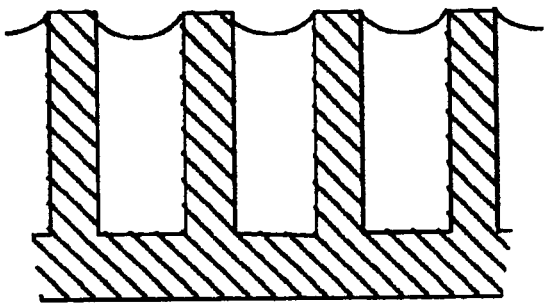
Figure 7A:
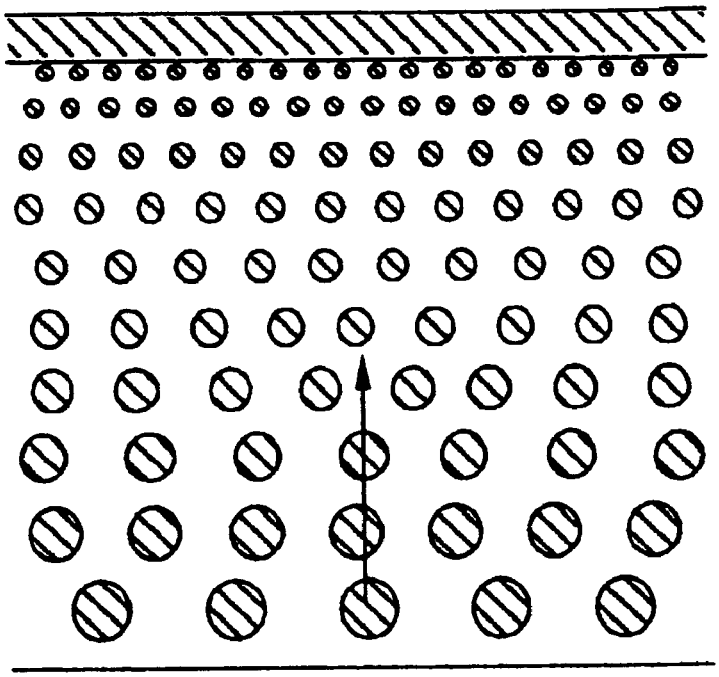
FIGS. 7A and 7B show a flow passage bounded by an array of rows of cylindrical posts of decreasing size but increasing density.
Figure 7B:
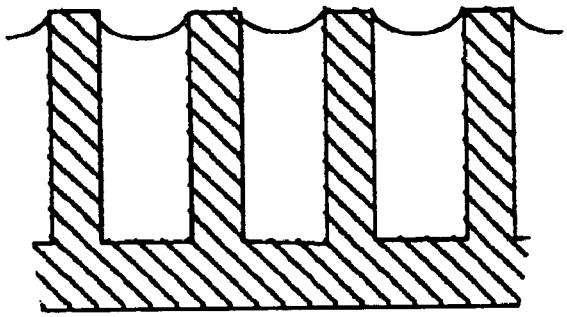

The embodiments illustrated in FIGS. 6 and 7 utilize arrays of cylindrical posts to reduce the effective width of the channels along the flow path. The post pattern shown in FIG. 7A is found to perform better then the embodiment shown in FIG. 6A since it maintains the same cross-sectional flow area along the flow path. The individual post cross-sections may be circular, square or any other shape. The post patterns are arbitrary. It is, however, necessary that the spacing between the posts be reduced along the flow path to approximate the characteristics of a tapered channel. FIGS. 6B and 7B show end views of these two embodiments through a representative row of posts.

Figure 8A:
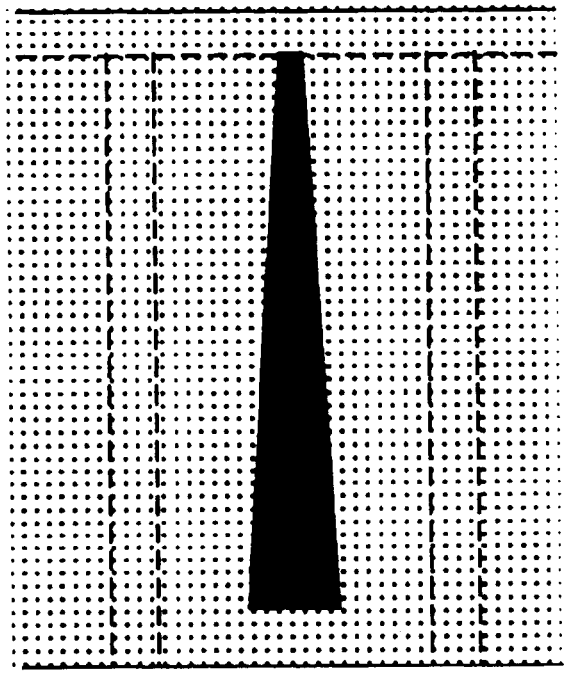
FIGS. 8A and 8B illustrate a channel covered by a plate through which a plurality of continuous tapered slots has been formed.
Figure 8B:
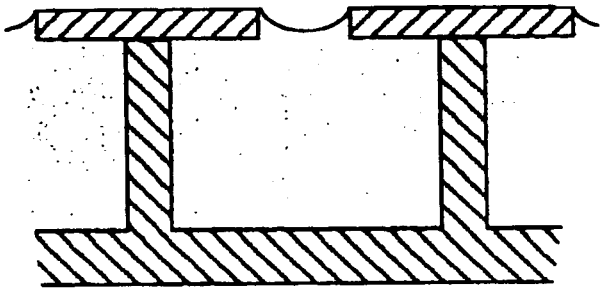
Figure 9A:
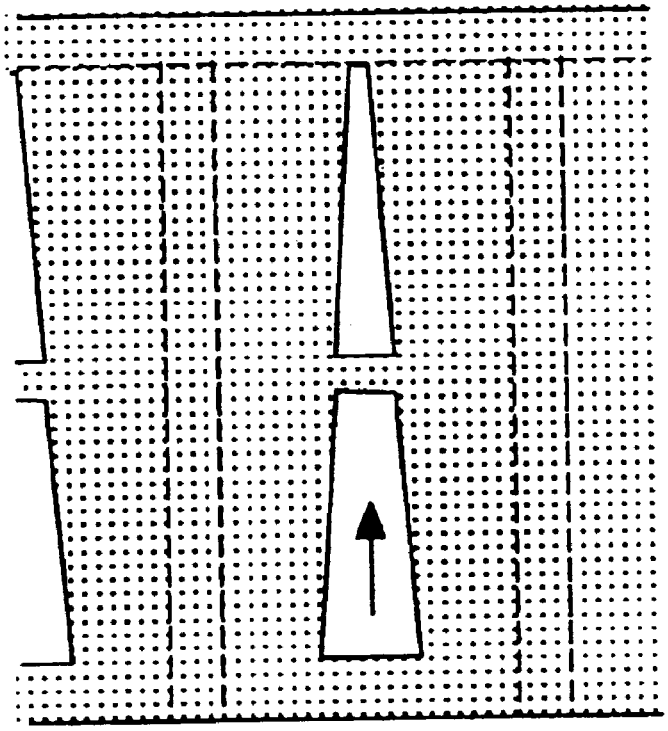
FIGS. 9A and 9B illustrate a channel having a discontinuously tapered slot in the cover plate.
Figure 9B:
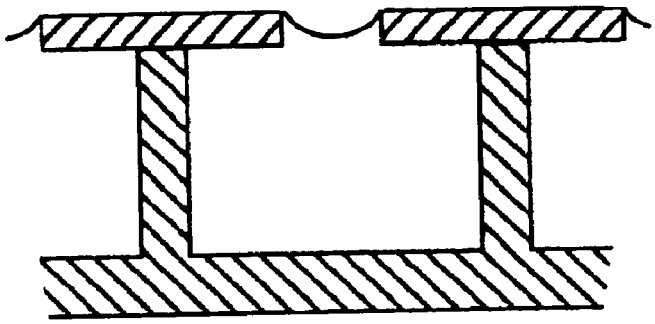
Figure 10A:
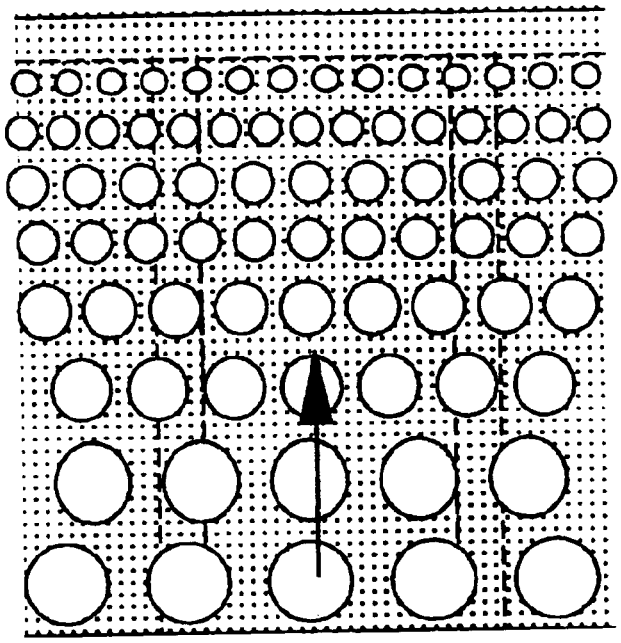
FIGS. 10A and 10B illustrate a channel having a pattern of circular holes in the cover plate having decreasing diameters but increasing density in the direction of flow.
Figure 10B:
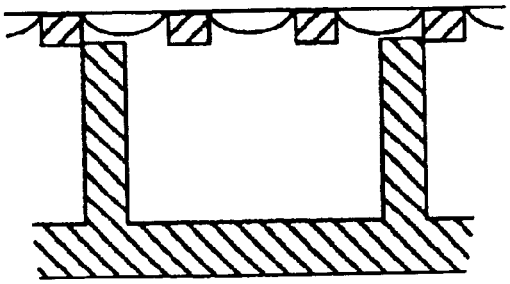

The embodiments illustrated in FIGS. 8, 9, and 10 utilize bi-layer channels. The upper layer consists of a cover plate having an open pattern of tapered slits or holes that grow progressively smaller in scale in the flow direction (see FIGS. 8A, 9A, and 10A). The lower layer consists of a channel structure of the present invention (more clearly seen in FIGS. 8B, 9B and 10B) having wider lateral dimensions that help to reduce fluid friction. The upper layer incorporates the small dimensions and the axial variations needed to provide large capillary pressure gradients as well as providing open features in which a meniscus can form; the lower layer carries the bulk of the flow. Details of the upper cutout pattern structure are unimportant except that they provide a surface along the interior wall of the opening on which the meniscus can form. The lower structure may alternatively consist of a post array having a relatively wide post spacing. The improvement in maximum sustainable heat flux, compared to a one layer device, is proportional to the square of the ratio of the lateral length scales of the two layers. Thus, a threefold increase in the length scale of the lower layer relative to the upper layer can provide a nine-fold increase in maximum sustainable heat flux.

All of the embodiments illustrated here are shown schematically to convey basic concepts. These schematics are not drawn to scale. In reality, channel lengths are on the order of at least about 1 to 3 centimeters for cooling of electronic devices. In contrast, optimal channel widths are typically less than 100 microns. So the channels are typically more than 100 times longer than their width.

Because of the limitations of traditional fabrication technologies, traditional channel depths have typically been no greater than two or three channel widths. However, the LIGA technology is capable of producing high aspect ratio channels having a depth tenfold or more greater than the channel width as well as depth. Channel depth dimensions ranging up to 1 mm or more, therefore, are not only possible but also very advantageous since the maximum sustainable heat fluxes of evaporative cooling devices are proportional to the channel depth. Channel depth, however, is limited. Dimensions greater than about a centimeter are thought to be impractical and/or nonfunctional due to the limitations of thermal conduction through the liquid and the potential for initiating boiling at the channel/liquid interface. Practical microchannel width-to-depth aspect ratios, therefore, while greater than that illustrated in the FIGURES, are about ten to thirty.

Figure 11:
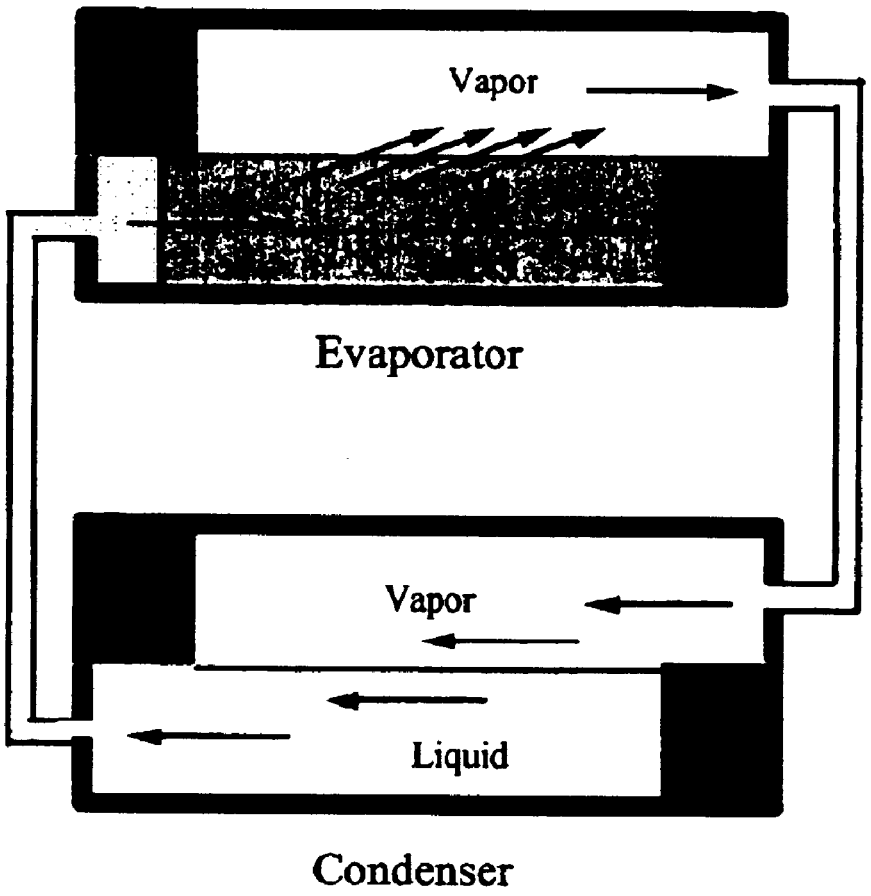
FIG. 11 illustrates the cross sections through evaporator and condenser units of a capillary pumped loop.
Figure 12A:
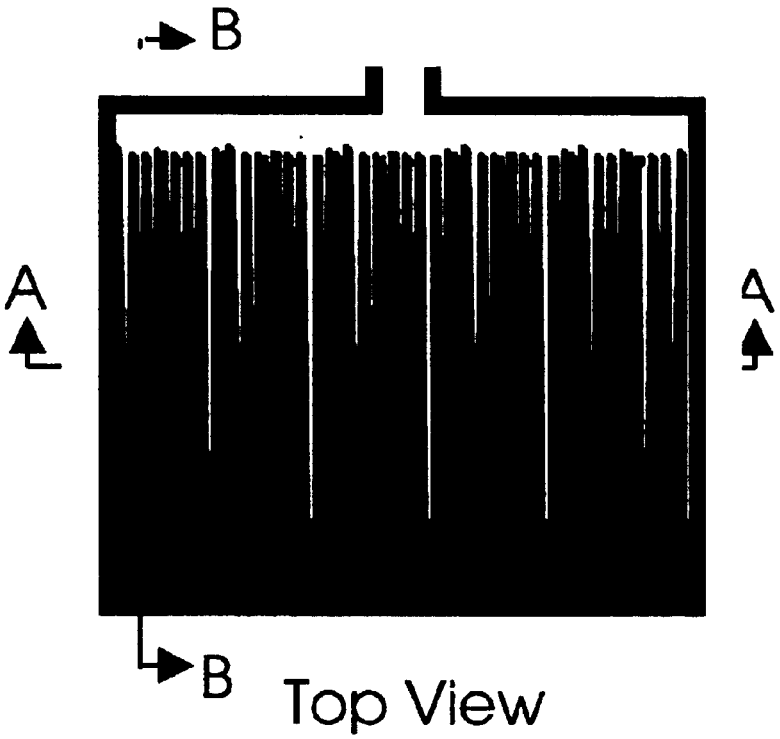
FIGS. 12A–12C show a cartoon representative of the evaporator and condenser unit of the present invention.
Figure 12B:
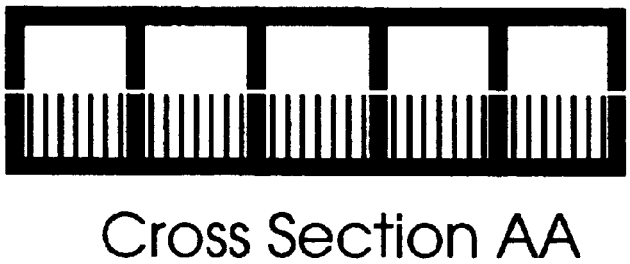
Figure 12C:
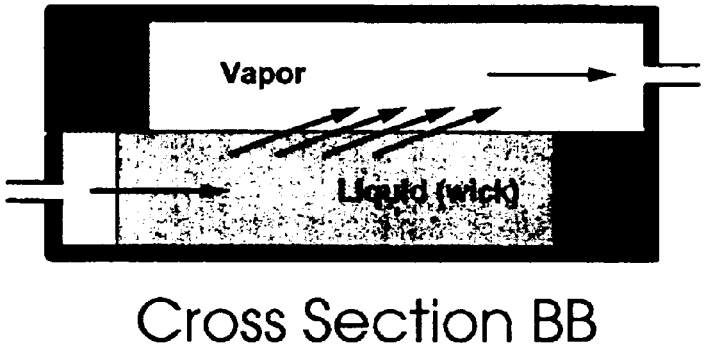

Any of the microchannel designs described above can be utilized in a variety of devices including heat pipes, capillary pumped loops, and heat spreaders. We have designed the particular capillary pumped loop system shown in FIGS. 11 and 12 so that it can be readily fabricated by LIGA. The evaporator and condenser units shown in FIG. 11 each consist of an upper plate and a lower plate. The outlet of each unit is connected to the inlet of the other unit by tubes. Details of the evaporator unit are shown in FIGS. 12A through 12C. Top view (see FIG. 12A) schematically illustrates the channel structure of the lower "wick" plate of the evaporator (the overlying vapor flow plate has been removed for clarity). The microchannels taper down in the direction of flow from the entry manifold (open region) toward the end wall. Cross section A—A (see FIG. 12B) again shows the closely spaced tapered wick channels that typically have optimal width dimensions of less than 100 microns. Section A—A further shows that the upper plate of the evaporator unit (shown above the close-packed channel array in section A—A) has widely spaced partitions but no microchannels since the presence of small passages would unnecessarily impede the vapor flow. Similarly, the condenser unit does not generally require microchannels so it is conveniently constructed using a pair of identical plates having widely spaced partitions but no microchannels, the same as the vapor flow plate of the evaporator. Thus, only two types of plates need to be fabricated, reducing production costs. FIG. 12C shows a side view cartoon of the flow direction and operation of the evaporator and condenser unit as viewed through one microchannel length.

Mathematical Model:

A mathematical model is used to demonstrate the effectiveness of tapered channels and to optimize system parameters. In this analysis we focus on cases where the channel depth is much greater than the channel width partly for simplicity and partly because maximum sustainable heat fluxes increase with fluid depth.

The one-dimensional mass conservation equation describing steady evaporating flow along the tapered microchannels of FIG. 4 may be written as $$h_{fg}\frac{d}{dx}(s\rho uA) = -q''W_b \tag{1}$$

Here $h_{fg}$ is the heat of evaporation, x is the axial position, ρ is the liquid density, u is the mean axial speed, A=HW is the cross-sectional area of a channel of width W and height H, and s is the liquid saturation describing the fraction of the channel containing liquid. It is assumed here that all of the heat flux q" applied to the channel bottom is carried away by local fluid evaporation. This flux is applied to a base width, $W_b$, somewhat greater then the corresponding channel width, W, owing to the presence of webs between neighboring channels.

The fluid speed, u, is determined by the balance between viscous friction, the gravity force along the channel, $\rho g_x$, and the gradient of the liquid pressure, $P_l$, $$u = -\frac{W^2}{12\mu}\left(\frac{dP_l}{dx} + \rho g_x\right) \tag{2}$$

The factor of twelve appearing in the denominator strictly applies only in the limit of deep channels where the flow resembles that between closely spaced parallel plates, but as shown by Schneider, et al., (AIAA Paper No. 80-0214; 1980) this constant can be adjusted to better approximate the friction in shallower channels. The viscosity $\mu$ is presumed uniform and the sign of the gravitational term implies that a positive gravity force opposes the pressure driven flow. The Young-Laplace equation relates the pressure difference across the phase liquid vapor interface, $P_l-P_v$, to the surface tension, σ, and the interfacial radius of curvature, R.

$$P_l - P_v = -\frac{\sigma}{R} \tag{3}$$

The radius of curvature will be based on only the component in the cross-sectional plane of the channel since the axial radius of curvature is usually much greater. Also for simplicity we will assume that the external vapor pressure is uniform.

Combination of Eqs. (1) and (2) yields a single ordinary differential equation describing axial variations of the normalized liquid pressure and saturation, $$\frac{d}{d\xi}\left(sw^3\left(\frac{dp}{d\xi} + G^*\right)\right) = Q^* \equiv \frac{q''}{H\rho h_{fg}}\left(\frac{12\mu}{\Delta P_o}\right)\frac{W_b L^2}{W_o^3} \tag{4}$$

where the lower case variables, and the parameter G* have been normalized in the following manner:

$$\xi = \frac{x}{L},\ w = \frac{W}{W_o}, \tag{5}$$

$$p = \frac{P_l - P_v}{\Delta P_o}\left(\text{where } \Delta P_o = \frac{\sigma}{R_o} \approx \frac{2\sigma}{W_o}\right), \text{ and } G^* = \frac{\rho g_x L}{\Delta P_o}.$$

The variables L, $W_o$, and $\Delta P_o$, are respectively defined as the channel length, the channel width at the entrance, and the maximum attainable capillary pressure in a channel of width $W_o$ associated with a radius of curvature $R_o$ corresponding to the minimum wetting angle. As indicated above, $\Delta P_o \sim 2\sigma/W_o$ for a wetting angle of zero degrees. The channel width is assumed to vary linearly along the channel from $W_o$ to $W_e$ such that $$w = \frac{W}{W_o} = 1 - \Delta w\xi \text{ where } \Delta w = \frac{W_o - W_e}{W_o} \tag{6}$$

Under the above scaling of liquid pressure, the minimum liquid pressure (corresponding to the minimum wetting angle) at any axial location is given by $$p_{\min} = -\frac{R_o}{R} = -\frac{W_o}{W} = -\frac{1}{w} = -\frac{1}{1-\Delta w\xi} \tag{7}$$

Although we have investigated other power-law variations of the channel width, linear tapers appear to provide the best overall performance under a range of operating conditions.

Figure 13:
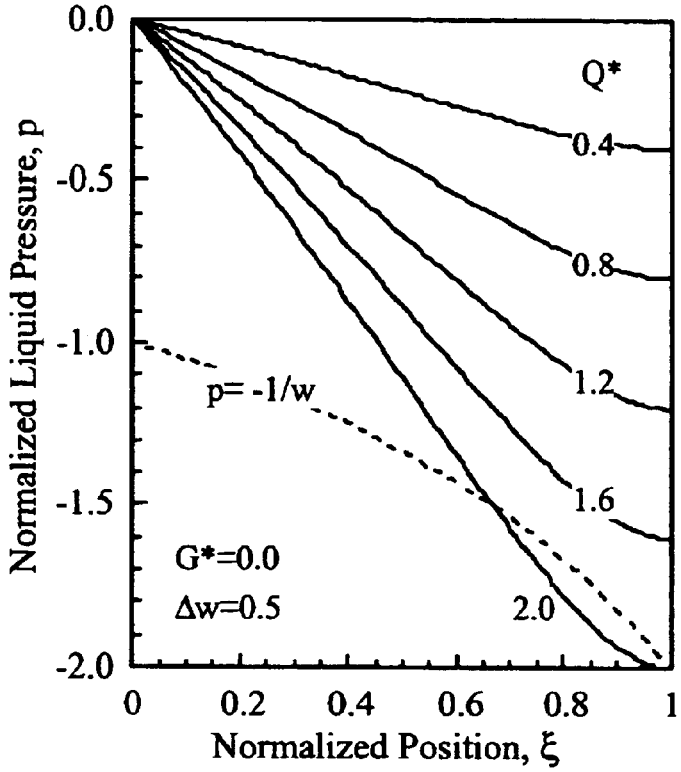
FIG. 13 shows the computed pressure distributions for various heat fluxes.

The governing differential equation, (4), is integrated analytically to determine the variation of liquid pressure and fluid saturation along a typical channel. The details of this have been reported in a companion technical paper. FIG. 13 illustrates pressure profiles for a normalized inlet pressure of zero corresponding to the flat meniscus of a fully saturated inlet region. For the chosen value of Δw=0.5, the width of the channel at its end (ξ=1) is half that at the inlet and so the minimum attainable value of the normalized liquid pressure is −2.0. Evaporation within the channel causes depression of the downward bowing meniscus, reducing the local pressure and drawing fluid into the channel. For a given heat flux, the meniscus (and liquid pressure) at the channel end are drawn down to an equilibrium level sufficient to maintain the flow rate needed to offset evaporative losses. With increasing Q*, the pressure at the channel end decreases and the radius of curvature becomes progressively smaller. Note that the pressure gradient at the channel end is always zero, consistent with the requirement that there be no flow through the end wall.

The dotted line in FIG. 13 corresponds to a normalized pressure of p=−1/w. In accordance with Eq. (7) this line indicates the minimum attainable liquid pressure at any location along the channel, corresponding to the minimum wetting angle at that location. Since the actual liquid pressure must always be greater, the solution shown for Q*=2 must be rejected. At a somewhat smaller value of Q* the end of the channel will begin to dry out causing the meniscus to recede into the channel, as illustrated in FIGS. 14 and 15.

Figure 14:
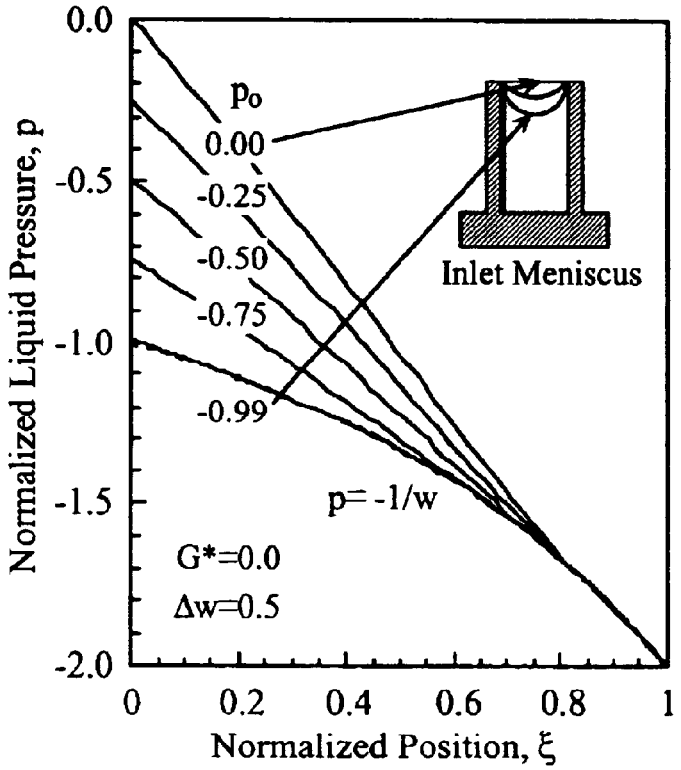
FIG. 14 shows the computed pressure distributions under conditions of maximum heat flux for various choices of inlet pressure.
Figure 15:
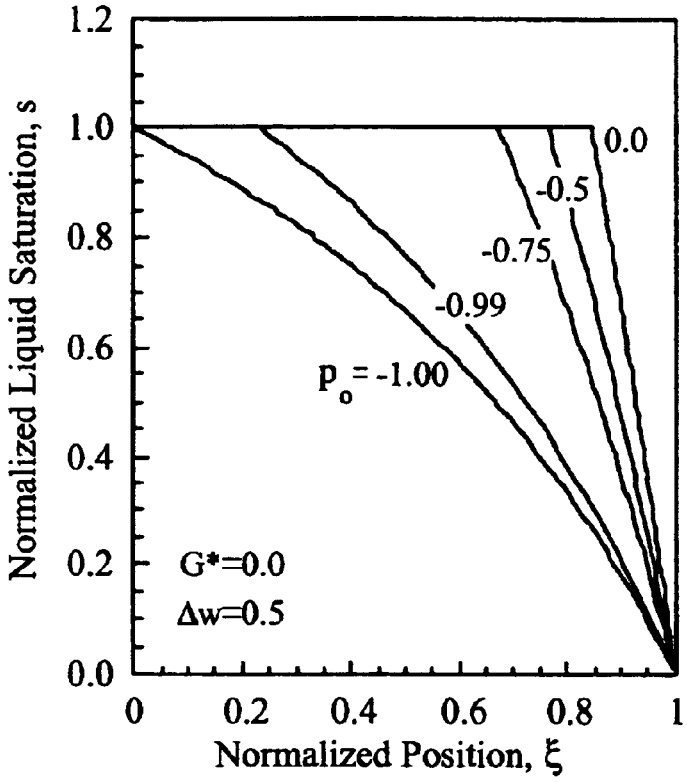
FIG. 15 shows the computed saturation profiles under conditions of maximum heat flux for various choices of inlet pressure.

FIGS. 14 and 15 illustrate pressure and saturation profiles corresponding to the maximum sustainable heat flux for Δw=0.5 and for various values of the inlet pressure, $p_o$=p(0). The uppermost curves for $p_o$=0 describe the end-member solution of the family just shown in FIG. 13; the corresponding heat flux is Q*=1.87. Each of these solutions has a liquid saturation of identically zero at the end of the channel. Thus, the corresponding values of Q* represent the maximum sustainable heat flux for the given parameters. For smaller Q*, the channel would be at least partially wet at the end. For larger Q*, the dry out point would move backward toward the channel inlet, causing the channel end to overheat.

Two distinct flow domains are apparent in FIGS. 14 and 15. In the entry or pinned-meniscus region, the meniscus curvature increases and the liquid pressure decreases with distance owing to changes in the contact angle, but the channel remains liquid full as indicated by a saturation of unity in the entry region of FIG. 15. For simplicity we have ignored the slight reduction in fluid saturation that occurs as the meniscus bows down into the channel because the corresponding fractional reduction in saturation is negligible for channels of high aspect ratio. In the recession domain, the meniscus is detached from the top corners of the channel, and the saturation decreases strongly along the flow path.

As seen in the inset of FIG. 14, smaller values of the inlet pressure, $p_o$, correspond to a greater meniscus curvature at the inlet. This reduction of the liquid pressure at the inlet is generally needed to draw liquid and vapor through the transport tubes of a capillary pumped loop. When the frictional pressure drop in these connector tubes increases, the inlet pressure must decrease so that less of the overall capillary pressure drop is available to draw the liquid into the evaporation channels. As a consequence, the associated dry out heat fluxes also decrease with $p_o$. It is also seen in FIGS. 14 and 15 that the transition point from a pinned meniscus to a receding meniscus moves backward with increasing $p_o$, reaching the entrance just as $p_o$ goes to zero.

Figure 16:
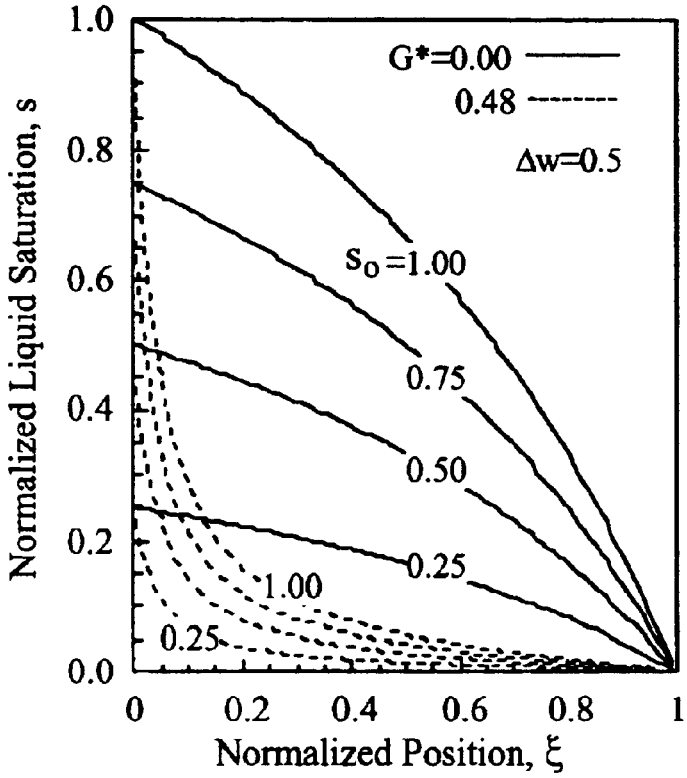
FIG. 16 shows the computed saturation profiles under conditions of maximum flux for various choices of the inlet saturation.

FIG. 16 presents saturation profiles for values of the inlet saturation, $s_o$, less than unity. Since s=0 at the leading edge of each, these again represent incipient dry out conditions where the heat flux is at its maximum sustainable value. Two sets of profiles are shown in FIG. 16. The upper set for G*=0 has no opposing gravitational force, while the lower set is for a gravitational force of G*=0.48, very close to the limiting value of G*=0.50 for which any heat flux is sufficient to dry out the channel. The maximum heat flux for this domain is proportional to Δw and is therefore zero for a straight channel. There can be no heat flux for Δw=0 because there can be no pressure gradient along a straight channel with a receding meniscus (see dead zone in FIG. 3) except in the bottom corners where the flow volume and speed become insignificant in the limit of high aspect ratio.

Figure 17:
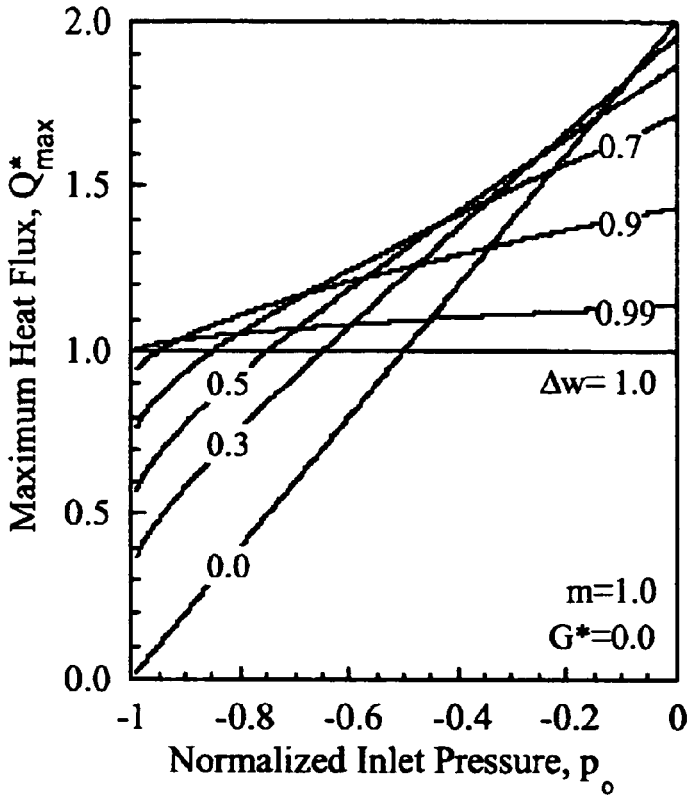
FIG. 17 shows the computed variation of maximum heat flux with inlet pressure for various linear tapers.

The variation of the dry out heat flux with the normalized inlet pressure is illustrated in FIG. 17 for G*=0 and for several values of the normalized taper, Δw. For Δw=0, the maximum flux is found to increase linearly with $p_o$, in accordance with the equality of the following analytical expression.

$$Q_{max} \leqq 2[1+(1-\Delta w)p(0)] \tag{8}$$

However, as seen in FIG. 17 this relationship clearly does not hold as an equality in the opposite extreme of a very strong taper, Δw=1. In this instance the maximum flux is simply unity, Q*=1, regardless of the inlet pressure. This behavior for large Δw is very robust in the sense that the maximum flux is not sensitive to inlet conditions that are sometimes influenced by other components within the system such as the pressure drops in the connector tubes of a capillary pumped loop.

For intermediate values of Δw the maximum flux profiles illustrated in FIG. 17 transition between these limiting straight lines that apply in the limits of Δw=0 and 1. Note that as $p_o \rightarrow -1$, the maximum flux is accurately given by Q*=Δw. In his limit, the transition point between pinned and receding meniscus domains approaches the channel entrance, leaving only the receding meniscus domain. At the opposite end of the pressure range where $P_o \rightarrow 0$, the maximum sustainable heat flux decreases with Δw, but the reduction from the global maximum of Q*=2.0 is only about 15% for Δw=0.7, increasing to a maximum possible reduction of 50% for Δw=1. So on the whole, it appears that taper is desirable in dealing with inlet conditions that are less than ideal (i.e., $p_o<0$) and that tapers of about 70% are the best practice.

The benefit of channel taper is greatest when an opposing gravitational force is present. This is because the stronger taper produces a smaller channel width at the exit, reducing the minimum liquid pressure available to draw fluid upward against gravity. Large values of G* correspond to relatively long channels having a gravity force component along the channels. G*=0 for horizontal operation in the absence of horizontal acceleration.

Figure 18:
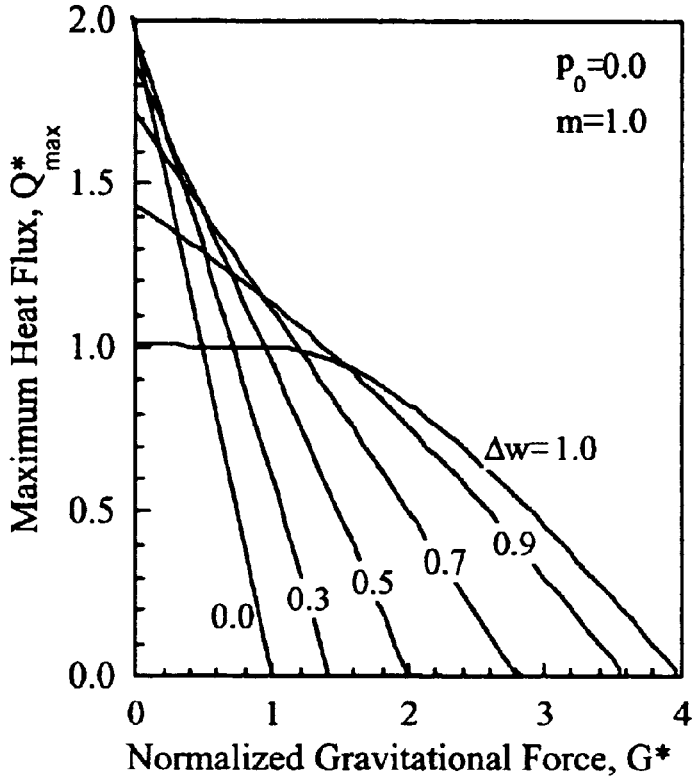
FIG. 18 shows the computed variation of maximum heat flux with opposing gravitational force for various linear tapers.

As seen in FIG. 18, a stronger taper extends the operating range of an evaporative cooling device to larger values of G*. In the absence of taper, the maximum heat flux, Q*, decreases linearly with G*, falling to Q*=0 at G*=1. A 50% taper (Δw=0.5) doubles the operating range to G*=2.0 while only slightly reducing the maximum sustainable heat flux for G*=0. With increasing taper, the maximum flux for G*=0 gradually decreases to Q*=1.0 while the operating range extends to G*=4.0 in the limit as Δw→1. However, a 70% taper can provide nearly a factor of three increase in the operating range while only reducing the maximum attainable flux at G*=0 by 15%. This amount of taper also provided well-balanced performance under variations in the channel inlet pressure, as seen earlier in FIG. 17.

Because of the popularity of evaporative cooling channels having a triangular cross section, we now compare their performance with that of tapered channels. We again consider the case of high aspect ratios partly for simplicity and partly because the maximum heat flux increases linearly with the channel depth, as explained earlier. In this limit, the axial fluid speed at any elevation may be taken as proportional to the width at that depth. Area weighted integration of this speed over the height of the groove indicates that the mean axial speed in the channel is given by Eq. (2) with the divisor in the denominator increased from 12 to 24, in good agreement with numerical results ranging from about 24.2 to about 27.6 for apex angles from 5 to 60 degrees as shown by Ayyaswamy, et al., (Journal of Applied Mechanics, 1974, pp. 332–336). This factor of two is combined with an additional factor of two reduction in the cross-sectional area of the channel to provide a reduction in heat fluxes by a factor of four. If we leave our scaling of Q* unchanged, this factor of four can be inserted as a divisor on the left sides of Eq. (4).

Assuming that the triangular groove is not tapered along its axis, it follows from our analysis of straight rectangular channels that a heat flux of Q*=(2./4.)=0.5 can be carried without any recession of the pinned meniscus into a triangular groove. Recall from FIGS. 13 and 17 that a tapered channel with a 50% reduction in width can carry a flux of about Q*=1.8 without recession of the meniscus. A 70% taper can carry a flux of about Q*=1.5 without recession. So by this measure of performance, the tapered channel is about a factor of three better than a triangular groove.

An important benefit of triangular grooves is that they continue to draw fluid by capillarity even when the meniscus falls below the pinning points at the top corners. This benefit is shared by axially tapered channels. To assess the relative performance under these conditions, suppose that the saturation at the channel inlet is near unity and that the entry meniscus is at its maximum curvature, so that any evaporation will cause recession of the meniscus into the channel. The governing equation for the triangular groove is obtained by inserting a factor of 4 into Eq. (4).

$$\frac{d}{d\xi}\left(sw_o\frac{w^2}{4}\left(\frac{dp}{d\xi}+G^*\right)\right)=Q^* \tag{9}$$

Here, one of the w's is subscripted with a zero to indicate that it should be taken at the inlet value of unity; this factor of w arose from the cross-sectional area of the channel which is constant. The remaining factor of $w^2$ accounts for frictional resistance and is correctly taken as the width of the groove at the top of the meniscus which decreases along the channel. The fractional saturation, s, is simply the product of the normalized fluid depth and width, again based on the local meniscus location. Further, since the normalized fluid depth ($h=(H/H_0)=(W/W_0)=w$) and the radius of meniscus curvature are both proportional to the meniscus width, $$s = hw = w^2 \text{ and } \frac{dp}{d\xi} = \frac{1}{w^2}\frac{dw}{d\xi} \tag{10}$$

Inserting these results into Eq. (9) and performing the integration yields a maximum heat flux of $Q^*=1/6$ for $G^*=0$.

$$\frac{w^2}{4}\frac{dw}{d\xi} = -Q^*(1-\xi) \text{ and } Q^*_{\max} = \frac{1}{6} \tag{11}$$

The corresponding maximum heat flux for a tapered channel is $Q^*=\Delta w$ as noted earlier in discussing FIG. 16. Thus, a channel taper of 20% ($\Delta w=0.2$) provides similar performance while a strongly tapered channel ($\Delta w=1.0$) can sustain a heat flux that is 6 times greater. Thus, even if the inlet meniscus should recede below the channel top, a tapered channel can easily outperform a triangular groove. In addition, the tapered channel can be readily produced lithographically while a triangular groove cannot.

Summarized Advantages of Tapered Channels:

Tapered channels expand the operating range of cooling devices by permitting operation under opposing gravitational forces of greater strength. As an example, a linear taper of 70% provides a 300% increase in the maximum allowable gravity force while only reducing the maximum flux under zero gravity (horizontal operation) by 15%. To obtain the same lifting capability in a straight channel would necessitate a factor of three reduction in channel width and, hence, a 300% reduction in the maximum heat flux for horizontal operation.

Another benefit of channel taper is improved performance under variations in the inlet liquid pressure. In a straight channel of high aspect ratio, the maximum sustainable heat flux becomes negligible as the inlet pressure approaches its minimum value corresponding to the minimum wetting angle. However, under this same inlet condition a channel with a 70% taper can still sustain a heat flux that is 40% of the maximum attainable for a flat meniscus at the inlet of a straight channel (see FIG. 17). A channel with a 100% taper ($\Delta w=1$) is entirely insensitive to the inlet pressure and is always able to sustain a heat flux that is 50% of that possible for a straight channel with a flat inlet meniscus.

Tapered channels continue to provide strong cooling performance even when the inlet meniscus falls below the top corners of channel. Under these conditions the maximum heat flux is simply proportional to the product of the inlet saturation and the channel taper. A straight channel cannot perform well at all under these conditions because the fixed wetting angle and fixed channel width imply that there can be no capillary driven flow except in the bottom corners of the channel and this flow becomes negligible at the high aspect ratios considered here.

Although channels of triangular cross section are frequently used in evaporative cooling applications (partly because they offer many of the robust performance features discussed above), a comparable tapered channel can sustain a heat flux that is 300% greater in the pinned meniscus regime and 600% greater in the receding meniscus regime. This comparison is made between tapered channels and triangular grooves having the same inlet width and the same high aspect ratio. Another advantage of tapered channels is that they can be readily fabricated lithographically whereas triangular grooves cannot.

A multiplicity of tapered channels can be fabricated together with peripheral manifolds and reservoirs using lithography-based technologies. The LIGA fabrication technique is specifically aimed at producing detailed metals parts of high aspect ratio having depth dimensions ranging up to millimeters and lateral dimensions ranging down to a few microns.

Figure 19:
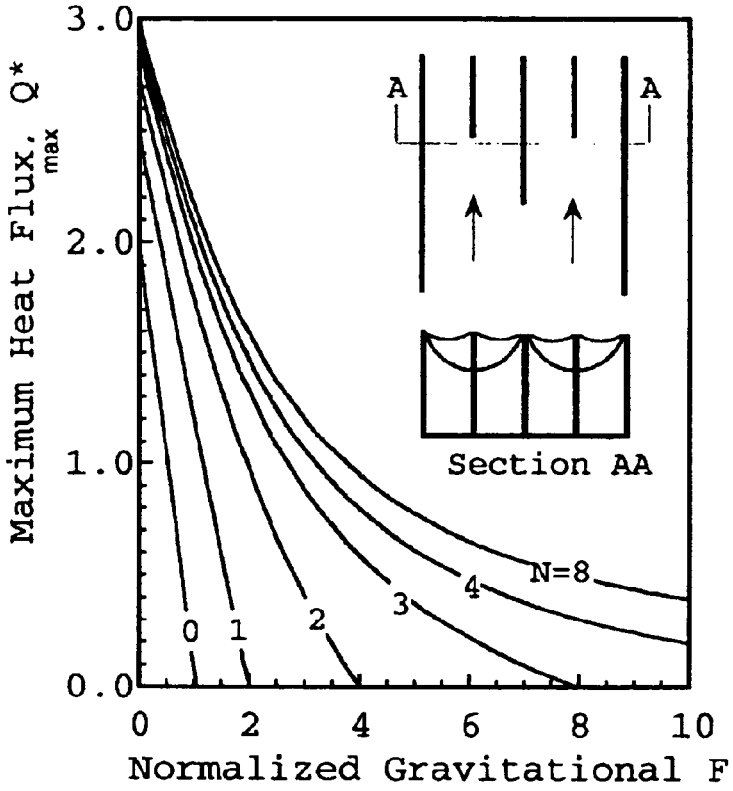
FIG. 19 shows the computed variation of maximum heat flux with gravitational force for channels divided N times.

Cascade of Progressively Narrower Channels:

The benefit of channel taper can be realized in a discrete, step-like manner by serial connection of a sequence of successively narrower straight channel segments. As an example, we consider a sequence constructed by insertion of partitions that progressively divide each of the channels over a portion of their length, as illustrated in FIGS. 5 and 19. The resulting flow path consists of N axial stages, with 1 channel in the first stage, 2 identical parallel channels in the second stage, 4 channels in the third stage, and so on. This configuration makes full use of the available plan-form area and is relatively easy to analyze by applying Eq. (4) to each successive stage. Since the $i^{th}$ stage consists of $n_i$ identical parallel segments, the width of each channel segment is computed by subtracting out the total width of $(n_i-1)$ dividers each having a normalized thickness, t, and dividing the remainder by $n_i$.

To optimize the device performance, we determined the lengths of the dividing partitions by requiring that all the available pressure drop be utilized in each successive stage. The meniscus curvature at the outlet of each segment must then be equal to the minimum possible value, and so $p_1=1/W_i$. Since the pressure must be continuous, the inlet pressure of the $i^{th}$ segment must be the same as the outlet pressure of the $(i-1)^{th}$, $p_{i-1}=(1/W_{i-1})$. This requires that the radius of curvature be the same on both sides of the transition between stages, as illustrated in the cross-sectional view of FIG. 19. The adjustment between the two meniscus profiles shown in FIG. 19 will take place over about one channel width on each side, a distance far smaller than typical axial dimensions. In the example calculations that follow the prescribed inlet pressure of the first stage, $p_o$, is taken as zero, corresponding to a flat inlet meniscus. Application of Eq. (4) to each of the N stages yields a system of equations that are solved for the N−1 unknown optimal partition lengths and the unknown heat flux $Q^*$ which is the same for all stages.

FIG. 19 illustrates the maximum sustainable heat flux as a function of the opposing gravitational force, $G^*$, for various numbers, N, of stages. For $G^*=0$, the maximum flux increases from $Q^*=2.0$ to 2.5 when a single partition is added, that is, when N increases from 0 to 1. The single partition of optimum length begins at $\xi=0.552$ and extends to $\xi=1$. Introduction of additional optimally sized partitions increases the maximum flux for $G^*=0$ in accordance with the sequence $$Q^*_{\max} = 2 + \sum_{i=1}^{N}\left(\frac{1}{2}\right)^{i-1} \tag{12}$$

toward a limit of $Q^*=3$ for an infinite number of stages. Fortunately, most of the benefit is gained with only two or three stages, since it is often impractical to introduce more than a few stages owing to the space occupied by the dividers themselves.

Our example calculations are for an idealized situation where the partition thickness is negligible compared to the inlet channel width. A uniform divider thickness that is 10% of the inlet width (t=0.1) will only permit a maximum of nine channels, so two or three stages are all that can be used for that case. Thus, a fabrication technology capable of producing very narrow partitions would certainly be beneficial. Although the divider thickness must be large enough to effectively conduct heat from the substrate to the evaporation interface, the width of the dividers can be cut in half at each stage while still maintaining the same total cross-sectional area for heat conduction, because the number of dividers doubles at each stage.

The benefit of split channels is greatest when the opposing gravity force is large, as clearly seen in FIG. 19. In the absence of any dividers (N=0), the maximum heat flux is zero for normalized gravitational forces greater than $G^*=1$. In contrast, the use of two stages extends the range of operation to $G^*=4$, while also increasing the maximum flux to $Q^*=2.75$, for $G^*=0$. To obtain the same gravitational lift using continuous straight channels would necessitate a factor of four reduction in channel width, reducing the sustainable heat fluxes by that same factor as apparent from the scaling relations given by Eqs. (4) and (5). However, it is important to point out that the results presented in FIG. 19 indicate maximum possible fluxes for configurations that are optimized for the indicated gravitational force. Thus, if we desire a system that operates well in a range from $G^*=0$ to 4, we might chose to optimize the geometry based on a gravitational force of $G^*=2$. Note that the maximum permissible $G^*$ (where $Q^*$ goes to zero) depends only on the number of stages.

Figure 20:
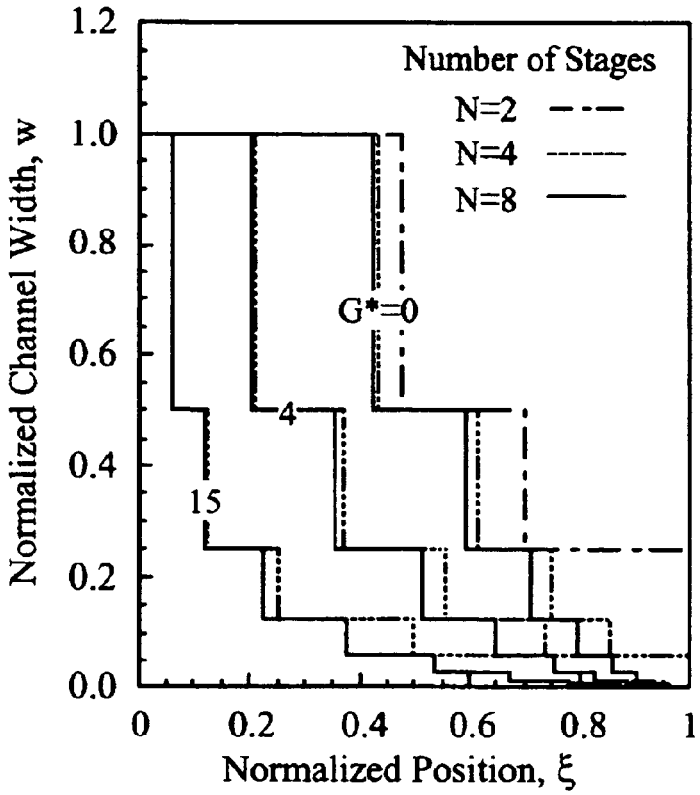
FIG. 20 shows the optimal stepwise variation of width along channels optimized for various gravitational forces, G*.

The channel width profiles of the optimized multistage channel configurations are illustrated in FIG. 20. The stair-step plots indicate the channel width as a function of axial position for the case of very narrow partitions. Channel shapes optimized for $G^*=0$ are shown for N=2, 4, and 8 stages. It is interesting to note that for G=0 the taper of the channel might be judged as nearly linear based on a construction of lines connecting the centers of the channel segments. It is also seen that the lengths of the first partitions are not greatly altered by insertion of additional partitions, since the locations of the first steps are relatively insensitive to the number of stages, N. This observation also holds true for shapes that are optimized for $G^*=4$ and 5. In these latter cases the results for N=2 are omitted to reduce the confusion of additional overlapping lines. It is seen that the optimum shapes for large $G^*$ have a convex profile that restricts the channel width at a greater than linear rate. However, as noted earlier, the linear shapes (here optimized for $G^*=0$) generally provide better performance under a broad range of conditions.

To summarize, a stepwise tapered channel system with optimally designed divisions generally provides better performance than a comparable linear taper, partly because the bisected or divided channels cover a greater portion of the total heated area. A stepwise taper can be fabricated using LIGA or any other technique capable of producing serially connected straight channels that are discretely stepped down in width along the flow path.

Axially Varied Micropatterning:

The main benefit of axial reduction in the channel width is the associated increase in the maximum available capillary pressure. Such taper also assures continued operation at low fluid depths. The detriments of taper are two-fold, a narrowing of the channel reduces the cross-sectional flow area and it also increases the fluid friction. The channel division scheme of the preceding section provides the full benefit while minimizing the reduction in cross-sectional flow area, particularly in cases where dividing partitions are few and their thickness can be made small compared to the channel width.

Another way to axially reduce the capillary pressure while maintaining the cross-sectional flow area is illustrated in FIGS. 6 and 7. In these designs there are no continuous channel walls. Instead, the evaporating coolant flows between an array of post-like features that are attached to the heated substrate. Lithography-based fabrication techniques can be used to produce any desired pattern of posts having circular, square, rectangular, elliptical, or any other cross-sectional shape. Most importantly, the spacing between the post surfaces can be reduced along the flow path to achieve a reduction in the minimum radius of meniscus curvature in a manner analogous to the previous designs having straight walls. In FIG. 6, this narrowing of the flow passages is realized by simply increasing the size of the posts such that the flow passages between them become progressively smaller. In this example, however, the flow area still decreases along the flow path.

The post pattern shown in FIG. 7 has a uniform porosity and hence a uniform flow area since the layout is produced by simply reducing the scale of the pattern in the axial direction. The patterned arrays have two other advantages over conventional channels with straight walls, tapered or not. First, the capillary pressure depends on the radius of curvature of a two-dimensional meniscus which has both axial and transverse components of similar magnitude that reinforce one another. When both components are of comparable magnitude, the minimum capillary pressure is reduced by a factor of two compared to a straight or tapered channel. In addition, the frictional forces in a post array having a given spacing are less than those in conventional channels having a comparable wall spacing. In the post array it is as though the wall is discontinuous so that the mean spacing between the "walls" is expanded, reducing the friction.

Multilayer Channels:

In each of the preceding channel designs the lateral length scale controlling viscous friction has been the same as that controlling the capillary pressure. The spacing between the channel walls or, equivalently, the distance between individual elements of the post pattern has been the determinant of both the minimum capillary pressure and the frictional resistance. Reduction of this length scale, l, is desirable because it reduces the minimum meniscus curvature and so increases the available capillary pressure differential ($\Delta p \sim 1/l$ ). However, such a reduction also increases the frictional resistance ($\tau \sim 1/l^2$).

The multilayer channel designs shown in FIGS. 8, 9 and 10 utilize a cover plate having a lateral length scale smaller than that of the underlying channels. The cover plate of FIG. 8 contains a tapered slot that is the only area of contact between the liquid and the adjacent vapor phase. Thus, the pressure difference between the phases (capillary pressure) is controlled by the meniscus curvature within that slot. Just as in a single-layer channel, the taper of the slot provides a lower minimum pressure at the outlet than at the inlet. Thus, so long as the meniscus remains attached to the side walls of the cover plate, this taper assures that fluid can be drawn to the far end of the evaporator (whereas a straight slit in the cover plate will not, owing to the dead zone issue illustrated in FIG. 3). Thus, the depth of the cover plate should be made thick enough to ensure fluid contact with the upper layer for the lowest expectations of fluid depth.

The primary channels beneath the cover plate have lateral dimensions considerably greater than those of the slits or holes in the cover plate. Wider spacing of the lower primary channel walls greatly reduces friction. However, these dimensions cannot be increased without limit because heat conduction through the lower channel walls and across the cover plate is relied upon to transport heat from the substrate to the meniscus where evaporation occurs. However, a primary channel width that is equal to the channel depth would only increase the conduction path length by about 50% while greatly increasing the fluid flow. As an example, suppose that the channel depth is on the order of 1 mm and that the slots in the cover plate have a width of about 50 microns. If the primary channel width in the lower level is increased from 50 microns (as in an open one-layer system) to 1 mm, viscous friction is reduced by a factor of more than 100, increasing the maximum flow rate and cooling capacity by that same factor.

The slits or holes in the cover plate need not be continuous, as illustrated in FIGS. 9 and 10. The introduction of closed portions helps to improve the structural integrity and the lateral heat conductivity of the cover plate. For any given cutout pattern, the overall pressure distribution in the liquid beneath the cover plate is still controlled by the interfacial vapor/liquid matching conditions that apply in the open portions of the pattern. As in open channels, excessive fluid depletion in any region of the channel causes downward bowing of the meniscus, lowering the local pressure and drawing fluid toward that location. The pressure in the liquid beneath the closed portions of the upper plate varies smoothly between these control points. Although fluid flow within open portions of the cover plate may be impeded by the lack of a continuous channel, this is of little consequence because nearly all of the flow passes beneath the plate.

A preferred pattern for a cover plate is illustrated in FIG. 10. The porosity of the plate is on the order of 50%. The circular hole pattern decreases in scale along the flow path to provide the same benefit as a tapered channel. In addition, the pattern need not be carefully aligned with the channel system below. The fluid and heat transport characteristics for this pattern are nearly insensitive to the alignment between upper and lower levels. This is in contrast to the axial slot patterns of FIGS. 8 and 9 which would perform poorly if the slots were inadvertently aligned just above the underlying channel walls, perhaps blocking the upward fluid flow to the meniscus or inadvertently interrupting the metallic conduction path from the base plate to the meniscus region where evaporation occurs.

The circular hole pattern of FIG. 10 is also advantageous in assuring a relatively short path length for lateral heat conduction in the cover plate. The holes are numerous enough and small enough relative to the underlying channel structure, that some of the holes will be quite near to the regions of contacts between the cover plate and the walls (webs) of the underlying channel structure.

Because the thermal conductivity of typical working fluids is about 100 times less than that of metals, it is important to maintain relatively close proximity between the cover plate and the tops of the underlying channel walls. This difficulty can be minimized by use of a relatively thin and hence flexible cover plate. Also, in a capillary pumped loop device like that shown in FIGS. 11 and 12, the cover plate will be sandwiched between the widely spaced partitions of the upper and lower halves of the evaporator.

Vertical flow of liquid through the open pattern of the cover plate to the meniscus does not place any severe restrictions on the cover plate design. Since the vertical velocity v through the cutout holes of area $A_h$ must account for all of the evaporative mass flux we can write $$\rho h_{fg} v A_h = Q A_b \text{ where } v \approx \frac{\Delta P_t}{h_t}\frac{w_t^2}{12\mu} \tag{13}$$

The second of the above expressions for the velocity, v, is similar to that given in Eq. (2) except that $w_t$ and $h_t$ refer to the width and depth of holes in the top plate, and $\Delta P_t$ is the vertical pressure differential across the plate. Similarly, evaporation of the longitudinal mass flux must also account for all of the evaporative flux.

$$\rho h_{fg} u w h = Q L w_b \text{ where } u \approx \frac{\Delta P_L}{L}\frac{w^2}{12\mu} \tag{14}$$

Combination of these expressions yields the following estimate for the ratio of the vertical and longitudinal pressure differentials.

$$\frac{\Delta P_v}{\Delta P_L} = \left(\frac{w}{w_t}\right)^2\left[\frac{h h_t}{L^2}\right]\frac{w}{w_b}\frac{A_b}{A_h} \approx \left(\frac{w}{w_t}\right)^2\left[\frac{h h_t}{L_2}\right] << 1 \text{ for } \frac{w_t}{w} >> \frac{\sqrt{h h_t}}{L} < \frac{1}{10} \tag{15}$$

Here we have set $A_h/A_b$=0.5 corresponding to a 50% porosity and $W/W_b$~0.5. Thus, the vertical pressure gradients will be relatively small provided that the ratio of the hole size to the lower channel width, $W_t/W$, is considerably greater than the ratios of the upper and lower channel depths to the length, a condition that is relatively easy to satisfy. For a channel length of L=20 mm, upper and lower layer depths of h=1 mm and $h_t$=0.2 mm, and a lower level channel width of 0.3 mm, the vertical pressure differential will be no greater than 10% of that available provided that the hole size, $w_t$, is greater than 20 microns. Furthermore, in this example the ratio of the lateral length scales between the upper and lower regions is 20/300, and provides more than a 100 fold reduction in friction compared to a 20 micron longitudinal channel.

What is claimed is:

1. An evaporative cooling device, comprising:

a working fluid comprising a liquid phase and a vapor phase;

one or more channels for containing said liquid phase, wherein each of said one or more channels comprises a first and second end, and wherein said liquid phase wets an interior surface of each of said channels forming thereby one or more menisci separating said liquid and said vapor phases;

a capillary pressure difference across each of said one or more menisci; and a means for establishing and maintaining a gradient in said capillary pressure difference in a direction from said first end to said second end substantially independent of the depth of said liquid phase in each of said one or more channels, wherein said gradient establishes a flow in said liquid phase in a direction from said first end to said second end.

2. The evaporative cooling device of claim 1, wherein said means for maintaining a gradient in said capillary pressure difference comprises varying the cross section of said channel in said flow direction.

3. The evaporative cooling device of claim 2, wherein said means for maintaining a gradient in said capillary pressure difference further comprises reducing a width of each of said one or more channels between said first and second ends.

4. The evaporative cooling device of claim 3, wherein reducing a width of each of said one or more channels comprises dividing a portion of said one or more channels, wherein said channels decrease in width in said flow direction.

5. The evaporative cooling device of claim 4, wherein dividing said channels comprises one or more partitions.

6. The evaporative cooling device of claim 3, wherein reducing a width of each of said one or more channels comprises continuously tapering a cross section of said channels in said flow direction.

7. The evaporative cooling device of claim 3, wherein said width is reduced by up to about 70% between said first and second ends.

8. The evaporative cooling device of claim 1, wherein said means for maintaining said gradient comprises an array of post-like features disposed in said one or more channels.

9. The evaporative cooling device of claim 8, wherein said post-like features comprise a cross-sectional shape selected from the list consisting of circles, ellipses, rectangles or polygons, and a height about equal to a depth of said one or more channels.

10. The evaporative cooling device of claim 9, wherein each of said post-like features is separated from every other said post-like feature by a minimum separation distance, wherein said minimum separation distance progressively decreases in said flow direction.

11. The evaporative cooling device of claim 10, wherein said post-like features are uniformly arranged in columns parallel to said flow direction and centered along equidistantly spaced axes.

12. The evaporative cooling device of claim 9, wherein said post-like features are uniformly disposed in rows perpendicular to said flow direction, and wherein the number of post-like features in each said row increases monotonically in said flow direction.

13. The evaporative cooling device of claim 1, further comprises a cover plate having one or more openings comprising an interior wall, wherein said cover plate covers said channel, and wherein a meniscus forms at said interior wall within each of said one or more openings.

14. The evaporative cooling device of claim 13, wherein said openings are triangular or trapezoidal, wherein the openings are tapered in said flow direction, and wherein said working fluid at least partially fills and wets said interior wall.

15. The evaporative cooling device of claim 14, wherein said triangular or trapezoidal openings are segmented.

16. The evaporative cooling device of claim 13, wherein said openings comprise a plurality of shapes selected from the list consisting of circles, ellipses, rectangles or polygons.

17. The evaporative cooling device of claim 16, wherein each of the openings in said flow direction comprises an area smaller than each previous opening.

18. The evaporative cooling device of claim 17, wherein said openings are uniformly disposed in rows perpendicular to said flow direction, and wherein the number of openings in each row increases monotonically in said flow direction.

19. The evaporative cooling device of claim 17, wherein said openings are uniformly arranged in columns parallel to said flow direction and centered along equidistantly spaced axes.

20. A heat exchanger comprising the evaporative cooling device of claim 1, and further comprising means for condensing and recirculating said working fluid.

21. A method for removing heat from a body, comprising the steps of:

providing a working fluid comprising a liquid phase and a vapor phase;

providing a thermally conductive substrate comprising one or more channels for containing said liquid phase, wherein each of said one or more channels comprises a first and a second end, wherein said liquid phase wets an interior surface of each of said channels forming thereby one or more menisci separating said liquid and vapor phases, and bringing said thermally conductive substrate into contact with a heated body, wherein a capillary pressure difference is generated across each of said one or more menisci by heating and evaporation of a portion of said liquid phase, wherein said capillary pressure difference establishes and maintains a pressure gradient in said liquid phase in a direction from said first end to said second ends;

substantially independent of the depth of said liquid phase in each of said one or more channels, said pressure gradient establishing a flow in said liquid phase in a direction from said first end to said second end.

22. The method of claim 21, further comprising the steps of condensing and recirculating the working fluid.

23. The method of claim 22, wherein said step of maintaining said pressure gradient comprises varying the cross section of said channel in said flow direction.

24. The method of claim 23, wherein said step of maintaining said pressure gradient further comprises reducing a width of each of said one or more channels between said first and second ends.

25. The method of claim 24, wherein reducing a width of each of said one or more channels comprises dividing a portion of said one or more channels, wherein said channels decrease in width in said flow direction.

26. The method of claim 25, wherein dividing said channels comprises one or more partitions.

27. The method of claim 24, wherein reducing a width of each of said one or more channels comprises continuously tapering a cross section of said channels in said flow direction.

28. The method of claim 25, wherein said width is reduced by up to about 70% between said first and second ends.

29. The method of claim 23, wherein said step of maintaining said pressure gradient comprises an array of post-like features disposed in said one or more channels.

30. The method of claim 29, wherein said post-like features comprise a cross-sectional shape selected from the list consisting of circles, ellipses, rectangles or polygons, and a height about equal to a depth of said one or more channels.

31. The method of claim 30, wherein each of said post-like features is separated from every other said post-like feature by a minimum separation distance, wherein said minimum separation distance progressively decreases in said flow direction.

32. The method of claim 31, wherein said post-like features are uniformly arranged in columns parallel to said flow direction and centered along equidistantly spaced axes.

33. The method of claim 30, wherein said post-like features are uniformly disposed in rows perpendicular to said flow direction, and wherein the number of post-like features in each said row increases monotonically in said flow direction.

34. The method of claim 23, further comprises a cover plate having one or more openings comprising an interior wall, wherein said cover plate covers said channel, and wherein a meniscus forms at said interior wall within each of said one or more openings.

35. The method of claim 34, wherein said openings are triangular or trapezoidal, wherein the openings are tapered in said flow direction, and wherein said working fluid at least partially fills and wets said interior wall.

36. The method of claim 35, wherein said triangular or trapezoidal openings are segmented.

37. The method of claim 34, wherein said openings comprise a plurality of shapes selected from the list consisting of circles, ellipses, rectangles or polygons.

38. The method of claim 37, wherein each of the openings in said flow direction comprises an area smaller than each previous opening.

39. The method of claim 38, wherein said openings are uniformly disposed in rows perpendicular to said flow direction, and wherein the number of openings in each row increases monotonically in said first direction.

40. The method of claim 38, wherein said openings are uniformly arranged in columns parallel to said flow direction and centered along equidistantly spaced axes.

* * * * *